US006271626B1

(12) United States Patent
Ford et al.

(10) Patent No.: US 6,271,626 B1
(45) Date of Patent: Aug. 7, 2001

(54) ELECTROLUMINESCENT MATERIAL COMPRISING A DOPED CONDUCTING OXIDE

(75) Inventors: Carol M. Ford, Columbia Heights; Randy J. Ramberg, Roseville, both of MN (US)

(73) Assignee: Honeywell Inc., Morristown, NJ (US)

( * ) Notice: Subject to any disclaimer, the term of this patent is extended or adjusted under 35 U.S.C. 154(b) by 0 days.

(21) Appl. No.: 09/131,559

(22) Filed: Aug. 10, 1998

(51) Int. Cl.[7] ..... H05B 33/14
(52) U.S. Cl. ..... 313/503
(58) Field of Search ..... 313/503, 505, 313/506, 509, 510; 427/66; 428/917

(56) References Cited

U.S. PATENT DOCUMENTS

| | | | |
|---|---|---|---|
| 4,027,192 | 5/1977 | Hanak | 313/498 |
| 4,563,297 | 1/1986 | Kukimoto et al. | 252/301.4 R |
| 5,128,587 | 7/1992 | Skotheim et al. | 313/504 |
| 5,303,319 | 4/1994 | Ford et al. | 385/131 |
| 5,319,727 | 6/1994 | Ford et al. | 385/30 |
| 5,418,182 | 5/1995 | Ford et al. | 437/129 |
| 5,543,237 | 8/1996 | Watanabe | 428/691 |
| 5,581,150 | 12/1996 | Rack et al. | 313/509 |
| 5,643,685 | 7/1997 | Torikoshi | 428/690 |

OTHER PUBLICATIONS

Darren Gebler, "Fabrication and Study of Polymer Light Emitting Devices," http://www.physics.ohio–state.edu/~ppl/pled.html (circa Oct. 1996).

P.H. deHaan, "Light Emitting Polymers—Light sources and displays of the future," http://www.tno.nl/instit/indus/lep43.html (No Date).

Hong Koo Kim, et al. "Erbium–Doped Indium Oxide Films Prepared by Radio Frequency Sputtering," *Journal of Vacuum Science Technology*, vol. 12, No. 6, Nov./Dec. 1994, pp. 3154–3156.

John P. Wheeler, "Light–Emitting Polymers Are Ready for Prime Time," *Photonics Spectra*, Apr. 1997, pp. 131–133.

*Primary Examiner*—Michael H. Day
(74) *Attorney, Agent, or Firm*—Kris T. Fredrick

(57) ABSTRACT

An electroluminescent substance suitably comprising a conducting material such as a conducting oxide and at least one light-emitting dopant is disclosed. Preferred embodiments of the electroluminescent substance include rare earth dopants present within the conducting oxide such that the dopant materials generate light when electrically stimulated. Common dopant materials include erbium, ytterbium, praseodymium and other rare earth elements. The electroluminescent material is suitable for use, for example, in an electronic display or as a light source for many applications including Sagnac rotation sensors such as fiber optic gyroscopes.

45 Claims, 2 Drawing Sheets

ELECTROLUMINESCENT MATERIAL COMPRISING A DOPED CONDUCTING OXIDE

FIELD OF THE INVENTION

The present invention relates generally to electroluminescent materials, and more particularly, to an improved electroluminescent light source that is particularly well-suited for use in a fiber optic gyroscope or an electronic display.

BACKGROUND OF THE INVENTION

Electroluminescent (EL) materials most often emit light in the visible or infrared spectrums when electrically stimulated. Common electroluminescent materials include, for example, zinc sulfide, calcium sulfide, strontium sulfide and various phosphor compounds such as phosphorous or zinc sulfate. Such materials are frequently used in various light sources, particularly in electronic displays such as, for example, flat panel displays, helmet-mounted displays, and heads-up displays. Although sulfides and phosphors provide adequate light for some applications, many of these substances are frequently susceptible to hydrolysis that may destabilize the light source or degrade the source's effective life. Moreover, many sulfides and phosphors exhibit undesirable thermal properties in that their thermal coefficients of expansion (TCE) frequently do not match those of many common display device packaging materials. With regard to manufacturability of these devices, this incompatibility often leads to low device yields due to narrow processing margins.

Adding rare earth elements such as, for example, erbium (Er), ytterbium (Yt), praseodymium (Pr) or cerium (Ce) to the electroluminescent material frequently enhances the light generating properties of an EL substance. Rare earth atoms are believed to produce light as electrons at high energy states release photons as they transition to lower energy states. To generate light, electrons in rare earth atoms must be "excited" from their natural energy state to a higher state. Excitation may be accomplished by any excitation method, such as, for example, electrical stimulation or "pumping" by an external light.

Erbium, for example, can be excited from the $I_{15/2}$ energy state to the $I_{13/2}$ state by shining a pump light having a wavelength of approximately 980 =l nm on the Erbium atoms. Different rare earth elements and different energy levels for each rare earth element require different frequencies of "pump" light to excite electrons into various states of excitation. After the rare earth element is excited, light may be generated by stimulating the excited atoms back to their original energy states by light of a second wavelength that is typically selected according to the particular energy state and particular rare earth element. To stimulate Erbium from the excited $I_{13/2}$ state to the $I_{15/2}$ state, for example, a stimulant light having a wavelength of about 1550 nm could be used. The light emitted will have a wavelength approximately equal to the wavelength of the stimulant light. Alternatively, electrons can be pumped and stimulated by electrical energy, as described herein. Typically, rare earth elements may be inserted into an EL substance by a heat injection method that typically involves heating a substrate material to a very high temperature (typically on the order of 400 degrees Celsius) and then injecting rare earth atoms into the molten substrate. Rare earth elements frequently tend to bond together (i.e., "cluster") at high temperatures, and therefore the heat injection method frequently results in uneven distribution of rare earth elements throughout the substrate. The uneven distribution typically results in degraded overall performance of the light source, because certain regions of the EL material substantially lack light-emitting rare earth atoms. Therefore, the heat injection method frequently results in sub-optimal quantities of light generated by the electroluminescent device. Clustering also frequently tends to decrease the amount of light generated because rare earth atoms that are closely clustered may absorb photons emitted by other atoms in the cluster, thus often reducing the total amount of light produced.

Several others have attempted to create rare-earth based EM materials, usually with disappointing results. For example, the article "Erbium-doped Indium Oxide Films Prepared by Radio Frequency Sputtering", written by Hong Koo Kim, et al, and published in the November/December 1994 edition of the Journal of Vacuum Science, which is herein incorporated by reference, generally discloses an attempt to create a light source by doping indium oxide with erbium in an RF sputtering environment. As noted by Kim, et al, conducting oxides such as InO may exhibit several beneficial light generating properties in that they generally have a wide band gap and are relatively easy to dope with rare earth elements. Kim, et al, note, however, that high levels of doping typically results in degraded crystallinity and therefore poor electrical properties. Indeed, the doped indium oxide material disclosed by the Kim, et al, reference allegedly produced some light, but not enough to be beneficial in a practical light source.

U.S. Pat. No. 4,027,192 issued to Joseph John Hanak on May 31, 1977, which is herein incorporated by reference, generally describes a display based upon a conducting oxide phosphor that also includes Indium Tin Oxide. Rare earth atoms are RF sputtered into the phosphor to adjust the resistance of the phosphor, which is stated to be on the order of $10^8$–$10^{10}$ Ω-cm. Although this display may be capable of generating some light, it retains a reliance on phosphor compounds that are frequently expensive and often difficult to manufacture. Similarly, U.S. Pat. No. 5,543,237 issued to Masao Watanabe on Aug. 6, 1996, the entire contents of which are herein incorporated by reference, generally discloses a light source for a flat panel display that includes a light emitting layer that is made up of an alkaline earth metal such as calcium, magnesium or barium doped with a rare earth element through a vapor deposition process.

It is therefore desirable to produce an electroluminescent light source that has improved environmental robustness (and therefore a longer life span) than sulfide light sources. It is also desirable to inject the source material with a high degree of rare earth dopant while minimizing clustering. Moreover, it is beneficial to produce a light source that is substantially transparent for use in flat panel, helmet-mounted or heads-up displays.

SUMMARY OF THE INVENTION

The present invention provides an electroluminescent material including a conducting material and at least one rare earth dopant such that a significant amount of light is produced when the material is electrically stimulated. In a preferred embodiment of the invention, the light emitting substance is made up of indium tin oxide (ITO) that is substantially doped with at least one rare earth element such as erbium (Er). The light emitting material is useful as a light source and is substantially transparent, making the material particularly well suited for use in, inter alia, electronic displays or Sagnac rotation sensors such as fiber optic gyroscopes. The light source is also well-suited for use as a resonating cavity in a resonance sensor. Moreover, the material exhibits better thermal expansion and environmental robustness than most sulfide or phosphor materials.

The invention is also advantageous because it provides an electroluminescent material that efficiently generates light with generally improved thermal and environmental properties, and is frequently substantially transparent.

BRIEF DESCRIPTION OF THE DRAWING FIGURES

Preferred exemplary embodiments of the present invention are described in conjunction with the appended drawing figures, wherein like numerals denote like elements and:

The above and other objects, features and advantages of the present invention will become apparent from the following detailed description of illustrative embodiments, to be read in conjunction with the accompanying drawings.

DETAILED DESCRIPTION OF PREFERRED EXEMPLARY EMBODIMENTS

1. A Fiber Optic Header

To simplify the description of the embodiments, the electroluminescent (EL) material is predominately described herein as a suitable component in an electronic display. Persons skilled in the art, however, would recognize that EL material could be used in any suitable application requiring sources of light. For example, EL substances could be used in place of a light emitting diode, or in place of a laser light source in an optical communications system. Alternatively, an EL material could be used as a source of light that is input into a fiber optic gyroscope or other rotation sensor based upon the Sagnac effect.

Figure 1:
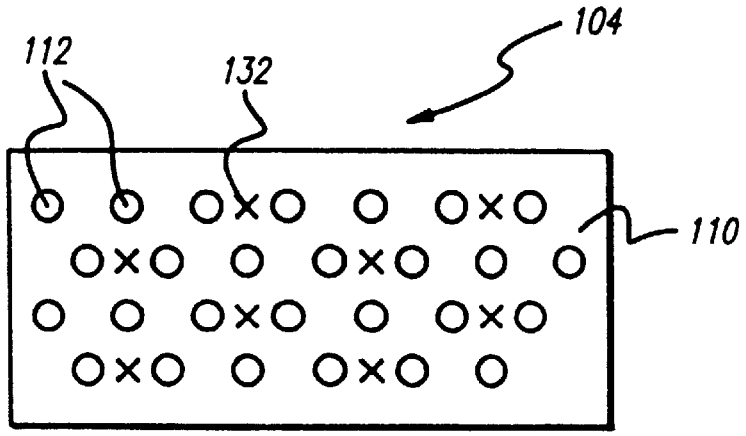
FIG. 1 is a cross-sectional view of an exemplary electroluminescent substance of one embodiment of the present invention.

Referring now to FIG. 1, an exemplary light emitting layer 104 is shown. Generally, light emitting layer (also referred to as EL layer) 104 preferably includes a conducting material 110 that is preferably doped with at least one rare earth element such as dopant 112 and optional cross-dopant 132.

Conducting material 110 is preferably any substance that is capable of conducting electricity such as, for example, a conducting oxide. Conducting oxides are selected because they are frequently transparent, yet capable of conducting electrical energy to dopant and cross-dopant materials. Well-known conducting oxides include, for example, indium oxide, indium tin oxide, barium titanate, cesium oxide, strontium titanium oxide, yttrium oxide, europium oxide and cadmium oxide, among others. In one preferred exemplary embodiment, indium tin oxide (commonly called ITO) is used. ITO is an indium oxide ($I_2O_3$) that has been doped with tin (Sn). ITO has been used as an electrode in electronic displays (see, e.g., U.S. Pat. No. 5,128,587, issued Jul. 7, 1992 to Skotheim, et al, which is herein incorporated by reference). However, ITO has rarely been used as the base material for an actual EL substance. Although ITO is used as a base material in a preferred embodiment, other transparent or non-transparent conducting oxides could also be used.

Dopant 112 is preferably present in base material 110 to increase the amount of light produced. Dopant 112 is any substance capable of producing cathodoluminescent light when electrically excited, but in a preferred embodiment, dopant 112 is a rare earth element. Rare earth elements are particularly well-suited for use as light-generating dopants because they are known to emit photons when transitioning between various states of excitation, as discussed above. Rare earth elements include, among others, erbium, ytterbium, praseodymium, cerium, neodium, samarium, europium, gadolinium, terbium, dysprosium, holmium and therulium. Alternatively, dopant 112 is implemented as a compound such as any compound that includes a rare earth dopant. Compounds that could be used include, for example, combinations of any rare earth element with, inter alia, flourine, chlorine, bromine, iodine or oxygen. The particular dopant selected depends upon the particular implementation and the desired use of layer 104. For example, dopant 112 is erbium or a compound of erbium such as erbium bromide in several embodiments, although other rare earth element such as praseodymium or ytterbium are used either independently or in combination with other dopants.

One or more optional cross-dopants 132 are also present in base layer 104. Cross-dopant 132 is preferably any material that is suitably used as dopant 112, such as a rare earth element. Frequently, two or more different dopants are desired, since different materials often produce light having varying wavelengths. It has been observed, for example, that a combination of erbium and ytterbium dopants produces substantially white light when electrically excited. Any suitable number of dopants 112 and cross-dopants 132 in varying proportions within layer 104 which produce sufficient light could be used.

The concentration of dopant 112 and cross-dopant 132 in relation to conducting material 110 often varies according to the particular implementation, but typically high concentrations of dopant 112 and cross-dopant 132, such as between 10–40%, are preferred over lower concentrations since heavily doped materials will generally emit more light than lesser-doped materials. Although the relative compositions of the dopant and cross-dopant may vary, an example of an effective layer 104 includes about a 10% concentration (by weight) of erbium and about a 10% concentration (by weight) of ytterbium.

It has been observed that very high levels of dopants 112 and cross-dopants 132 are suitably placed in layer 104 through reactive ion beam sputtering (RIBS) using the "mosaic" method originally disclosed in U.S. Pat. application Ser. No. 08/801,929, filed Feb. 15, 1997, naming Carol M. Ford and Randy J. Ramberg as inventors, which is incorporated herein by reference.

Figure 2:
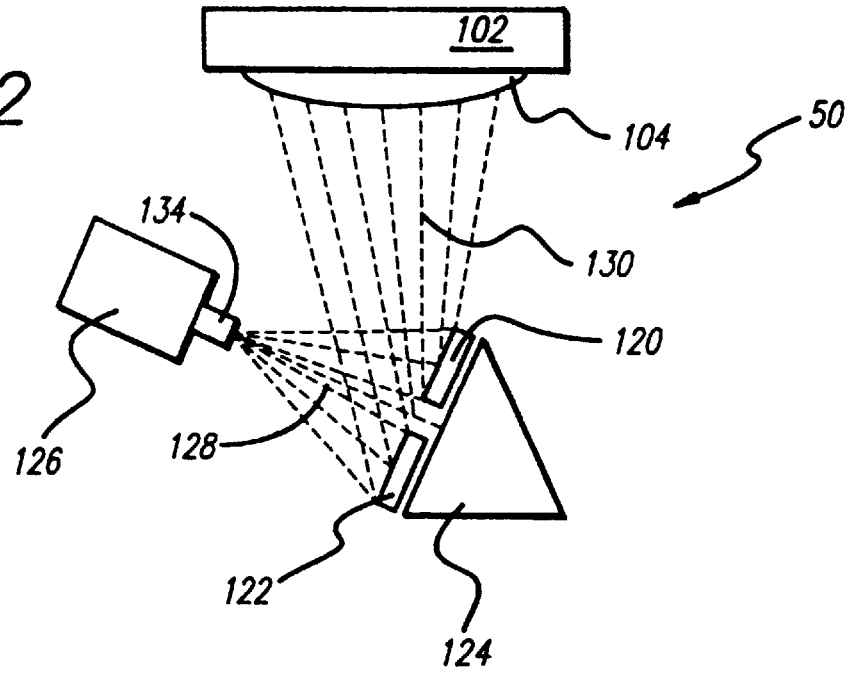
FIG. 2 illustrates an exemplary apparatus for formulating the electroluminescent substance.

Referring now to FIG. 2, an exemplary setup 50 for suitably implementing the "mosaic" method of ion beam sputtering is shown. A target 124 is preferably formulated of a substance that corresponds to conducting oxide 110. For example, if conducting oxide 110 is desired to be indium tin oxide, then target 124 is formed primarily of ITO. Target 124 is preferably placed in proximity to an ion gun 126 such that ions from ion beam 128 emit from end 134 of gun 126 and substantially impinge upon target 124.

Doping and cross-doping in the mosaic method is preferably accomplished by forming foils or films of dopant and cross-dopant material, such as the foils shown as elements 120 and 122 in FIG. 2. In the mosaic method of RIBS, foils 120 and 122 are preferably placed substantially near target 124 such that part of ion beam 128 impinges upon foils 120 and 122, and part of ion beam 128 impinges upon target 124. Particles 130 are then dislodged from the foils and the target, and these particles 130 are then deposited upon substrate 102, forming an EL layer 104. The percentage of material making up EL layer 104 is substantially proportional to the percentage of beam 128 impinging upon the various foils and targets. For example, if 10% of beam 128 substantially impinges upon a foil 120 that is made up of erbium, and if 10% of beam 128 substantially impinges upon a foil 122 that is made up of ytterbium, and if the remaining 80% of beam 128 substantially impinges upon the target 124 that is made up of indium tin oxide, then the resulting EL layer 104 will be comprised of about 80% ITO with about a 10% erbium dopant and about a 10% ytterbium cross-dopant. Very high levels of dopant, and cross dopant (on the order of 50% and higher) may be produced with the mosaic method.

A significant advantage of the mosaic RIBS method is that the resulting composition of EL layer 104 will be substantially homogenous. That is, the relative compositions of base material 110, dopant 112 and cross-dopant 130 will be substantially constant throughout EL layer 104. Clustering that typically results from other doping methods is also substantially absent in EL layers 104 created with the mosaic method. By reducing the clustering of dopants and cross-dopants, the amount of light generated is typically increased, as discussed above After sputtering is substantially complete, EL layer 104 can optionally be exposed to a second ion beam (not shown) or to beam 128 from gun 126. By exposing EL layer 104 to the ion stream, the structure of layer 104 is made substantially crystalline. Although layer 104 produces light even if the structure is left substantially amorphous (as will be the result of the sputtering process), some crystallized embodiments produce more light under certain conditions.

In an alternative embodiment, substrate 102 and sputtered layer 104 are baked at a temperature of 200–1000 degrees Celsius following sputtering. Typically, baking takes place at a temperature of about 400–700 degrees, although the exact baking temperature is dependent upon the particular materials used as base material 110, dopants 112, cross dopants 132 and substrate 102. In addition to or in place of exposing layer 104 to an ion beam for a second time to achieve crystallinity, the layer may be made substantially crystalline by adjusting the conditions of the baking process. For example, by raising the temperature to about 500–900 degrees Celcius, many materials will be made substantially crystalline. Besides temperature, the pressure or gaseous content of the baking oven can be adjusted. For example, baking in oxygen, nitrogen or air often will affect the bake process and will result in increased crystallinity. Crystallized substances typically emit more light than non-crystallized substances. Moreover, crystallinity frequently affects the wavelength of the output light.

Figure 3:
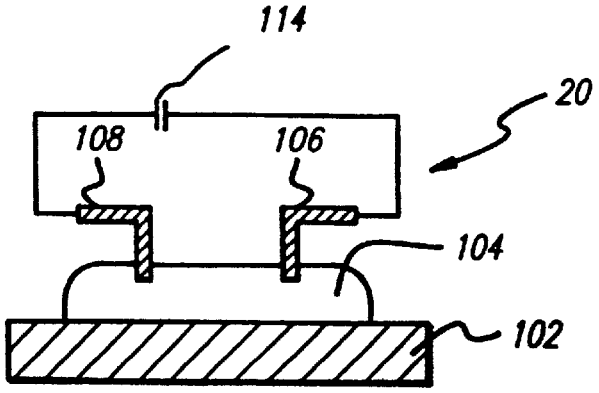
FIG. 3 is a cross-sectional view of a first exemplary embodiment of an electroluminescent device.

FIG. 3 shows a first exemplary embodiment of light emitting device 20. Light emitting layer 104 is shown attached by preferably an adhesive to substrate 102. Two electrodes 106 and 108 suitably provide energy from electrical source 114 to electrically excite the light emitting layer 104, thereby producing light.

Substrate 102 is preferably any thermally stable material suitably capable of supporting EL layer 104. Common substrates known in the prior art include, for example, ZERODUR glass, silicon, silicon dioxide, gallium arsenide or any other types of glass. Moreover, those skilled in the art recognize that many metals and polymers have physical and thermal properties that allow these materials to be used as substrates, even though these materials have not been commonly used in the prior art because, for example, many prior art deposition and sputtering methods take place at temperatures that would melt the material. EL layers created through the mosaic RIBS method disclosed above, however, do not typically require substantial heating of the substrate before or during sputtering/deposition. Therefore, many substrates that have not been used in the prior art such as plastics, polymers, metals and other materials with low melting points are preferably used to implement substrate 102.

Energy source 114 is any suitable source of electrical energy for exciting EL layer 104. Although source 114 is shown in FIG. 3 as a D.C. voltage source, an A.C. source is alternatively used. Similarly, the bias direction of the voltage source 114 shown could be reversed, since light may emit from EL layer 104 whether source 114 is forward or reverse biased. Although the resistance of layer 104 may vary dramatically depending upon the base materials, for example, dopants and cross-dopants used within layer 104, the resistance is frequently (although not necessarily) on the order of $10^1$–$10^3$ Ω.

Many arrangements for providing electrical stimulation to EL layer 104 are within the scope of the present invention. For example, electrodes 106 and 108 in FIG. 3 are shown as standard strips of any well-known conductor such as copper, silver or gold.

Figure 4:
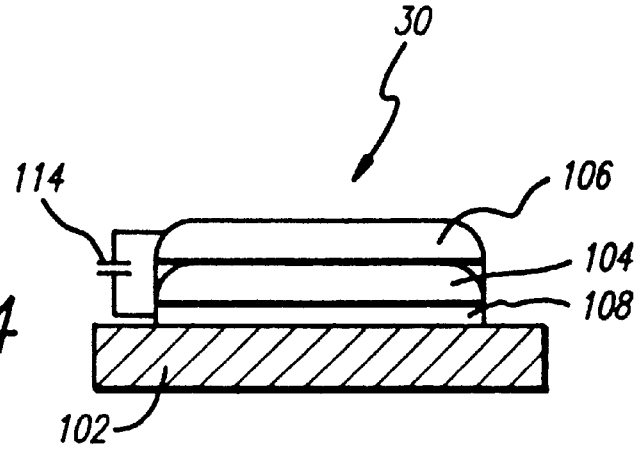
FIG. 4 is a cross-sectional view of a second exemplary embodiment of an electroluminescent device.

FIG. 4 shows another exemplary embodiment 30 that preferably includes a lower electrode layer 108 and an upper electrode layer 106 deposited on either side of EL layer 104. The electrode layers 106 and 108 is any suitable substance that is capable of conducting electricity such as a metal, conducting oxide, or other conducting substance. Indium tin oxide is a particularly well-known suitable conducting material, for example, as are all of the conducting oxides discussed above.

Figure 5:
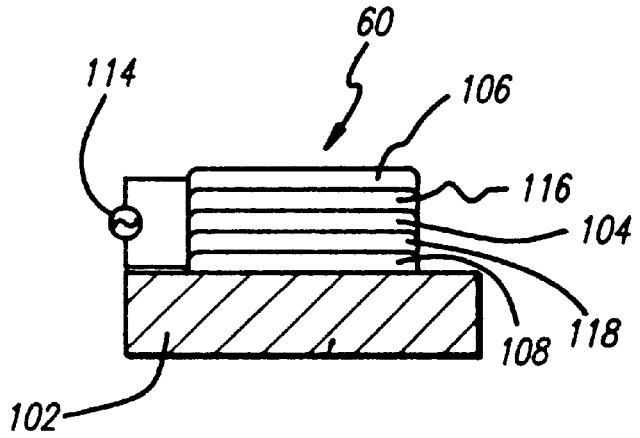
FIG. 5 is a cross-sectional view of a third exemplary embodiment of an electroluminescent device.

FIG. 5 shows an exemplary embodiment of a light-emitting device 60 that includes multiple layers deposited upon substrate 102. Lower electrode 108 is preferably placed upon substrate 102, and an insulating material 118 such as, for example, silicon dioxide or silica nitrate is preferably placed on top of lower electrode 108. Layer 104 is preferably placed next, followed by an upper insulating layer 116. Layer 116 is preferably the same material as lower insulating layer 118, or alternatively, layers 116 or 118 may be made up of differing substances. An upper electrode layer 106 of conducting oxide is preferably placed on top of upper insulating layer 116. In FIG. 5, electrical source 114 is shown as an AC current source, but any form of A.C. or D.C. source are within the scope of the present invention. Similarly, the electrical source 114 is preferably forward or reverse biased.

Figure 6:
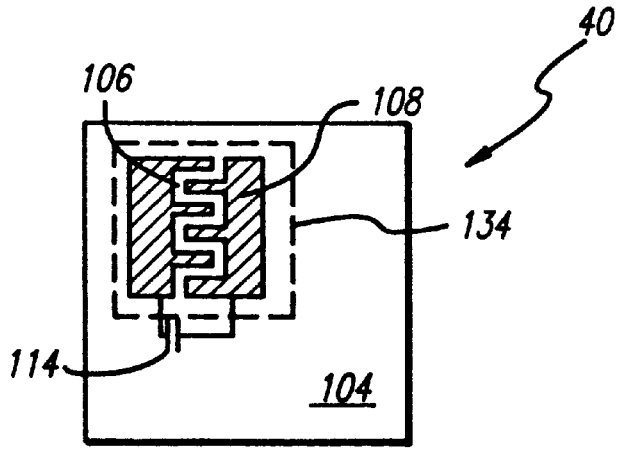
FIG. 6 is a top-down view of an exemplary display element for an electronic display.

FIG. 6 shows an exemplary embodiment 40 with a light emitting pixel 134 suitable for use in an electronic display. Electrodes 106 and 108 are shown as comb-shaped conducting elements that are attached to EL layer 104. Although electrodes 106 and 108 are shown in FIG. 6 to be comb shaped, the electrodes may exhibit any suitable form such as rectangular, triangular, round, or any other form. Electrodes 106 and 108 are preferably attached to layer 104 by, for example, an adhesive such as an epoxy. Alternatively, electrodes 106 or 108 may be attached to layer 104, embedded in layer 104, or placed in close proximity to layer 104 through any suitable method. As electrical energy flows from source 114 to electrodes 106 and 108, region 134 of EL layer 104 completes the electrical circuit, and current reaches dopant and cross-dopant particles in layer 104. The dopant and cross-dopant particles then become substantially electrically excited, resulting in emitted light. It has been observed that light of varying frequencies is generated by varying the quantities and types of dopants and cross-dopants used in layer 104, as well as by varying the electrical energy provided to the pixel 134. For example, it is known that ytterbium and erbium combinations are capable of producing at least yellow, green, purple or blue light. It is known that most light emitting materials emit a broad spectrum of frequencies including frequencies in both the visible light spectrum and the infrared spectrum.

Alternatively, dopant and cross-dopant particles in light-emitting layer 104 are suitably excited with a pump light and then electrically stimulated to produce light. Lights of varying frequencies are suitably produced by this method. For example, ytterbium produces green light when pumped with 980 nm light and electrically stimulated, a surprising result since green light is often associated with a relatively low frequency in the visual spectrum, and 980 nm is a relatively high frequency pump light. Light produced through this method is often substantially coherent, making the light source useful in, for example, fiber optic gyroscopes (FOGs) or resonator micro-optic gyroscopes (RMOGs). Alternatively, the light source is used in place of a laser diode, or any other light source in various applications in optical communications, for example. The corresponding structures, materials, acts and equivalents of all elements in the claims below are intended to include any structure, material or acts for performing the functions in combination with other claimed elements as specifically claimed. The scope of the invention should be determined by the appended claims and their legal equivalents, rather than by the examples given above.

The claimed invention is:

1. An electroluminescent device comprising:

a substrate;

a substantially phosphor free light emitting layer comprising:

a conducting oxide coupled to the substrate; and a dopant material substantially distributed through the conducting oxide; and electrodes configured to apply an electrical potential across the light emitting layer;

wherein the light emitting layer emits light having a frequency when an electrical potential is applied across the light emitting layer.

2. The electroluminescent device of claim 1 wherein the electrodes comprises first and second electrodes, and wherein the first and second electrodes are electrically coupled to the light emitting layer.

3. The electroluminescent device of claim 1 wherein the electrodes comprise first and second electrodes, and wherein the first and second electrodes are formed as layers.

4. The electroluminescent device of claim 1 wherein the electrodes comprise first and second electrodes, and wherein the first and second electrodes are embedded in the light emitting layer.

5. The electroluminescent device of claim 1 wherein the electrodes comprise first and second electrodes, and wherein the first and second electrodes are in close proximity to the light emitting layer.

6. The electroluminescent device of claim 1 wherein the electrodes comprise first and second electrodes, and wherein the electroluminescent device further comprises a first insulation between the first electrode and the light emitting layer and a second insulation between the second electrode and the light emitting layer.

7. The electroluminescent device of claim 1 wherein the electrodes comprise first and second electrodes, and wherein the first and second electrodes are combs.

8. The electroluminescent device of claim 1 wherein the conducting oxide comprises Indium Tin Oxide (ITO).

9. The electroluminescent device of claim 8 wherein the dopant material comprises at least one rare earth element.

10. The electroluminescent device of claim 8 wherein the dopant material comprises at least 20% by weight of the light emitting layer.

11. The electroluminescent device of claim 8 wherein the dopant material comprises at least 10% by weight of the light emitting layer.

12. The electroluminescent device of claim 8 wherein the dopant material comprises at least 5% by weight of the light emitting layer.

13. The electroluminescent device of claim 8 wherein the dopant material comprises at least 1% by weight of the light emitting layer.

14. The electroluminescent device of claim 8 wherein the light emitting layer is substantially crystalline in structure.

15. The electroluminescent device of claim 1 wherein the dopant material comprises at least one rare earth element.

16. The electroluminescent device of claim 15 wherein the light emitting layer is substantially crystalline in structure.

17. The electroluminescent device of claim 1 wherein the dopant material comprises at least 20% by weight of the light emitting layer.

18. The electroluminescent device of claim 1 wherein the dopant material comprises at least 10% by weight of the light emitting layer.

19. The electroluminescent device of claim 1 wherein the dopant material comprises at least 5% by weight of the light emitting layer.

20. The electroluminescent device of claim 1 wherein the dopant material comprises at least 1% by weight of the light emitting layer.

21. The electroluminescent device of claim 1 wherein the light emitting layer is substantially crystalline in structure.

22. The electroluminescent device of claim 1 wherein the frequency is in the visible light spectrum.

23. The electroluminescent device of claim 1 wherein the frequency is in the infrared spectrum.

24. The electroluminescent device of claim 1 wherein the dopant material is in the range of 10% to 40% by weight of the light emitting layer.

25. The electroluminescent device of claim 1 wherein the dopant material is a first dopant material, wherein the light emitting layer includes a second dopant material, and wherein the first and second dopant materials are based upon different rare earth elements.

26. A method of generating light comprising:

providing a light emitting substance consisting essentially of indium tin oxide and at least one dopant; and applying an electrical potential across the light emitting substance.

27. The method of claim 26 wherein at least one dopant comprises a rare earth element.

28. The method of claim 27 wherein the rare earth element comprises erbium.

29. The method of claim 27 wherein the rare earth element comprises ytterbium.

30. The method of claim 27 wherein the rare earth element comprises praseodymium.

31. An electroluminescent device comprising:

a substrate;

a light emitting layer consisting essentially of:

a conducting oxide coupled to the substrate; and at least one dopant material substantially distributed through the conducting oxide; and a potential applying device configured to apply an electrical potential to the light emitting layer;

wherein the light emitting layer emits light having a frequency when an electrical potential is applied across the light emitting layer by the potential applying device.

32. The electroluminescent device of claim 31 wherein the potential applying device includes first and second electrodes electrically coupled to the light emitting layer.

33. The electroluminescent device of claim 32 wherein the dopant material comprises at least one rare earth element.

34. The electroluminescent device of claim 32 wherein the first and second electrodes are layers.

35. The electroluminescent device of claim 32 wherein the first and second electrodes are embedded in the light emitting layer.

36. The electroluminescent device of claim 32 wherein the first and second electrodes are in close proximity to the light emitting layer.

37. The electroluminescent device of claim 32 further comprising a first insulation between the first electrode and the light emitting layer and a second insulation between the second electrode and the light emitting layer.

38. The electroluminescent device of claim 32 wherein the first and second electrodes are combs.

39. The electroluminescent device of claim 31 wherein the conducting oxide comprises Indium Tin Oxide (ITO).

40. The electroluminescent device of claim 31 wherein the dopant material comprises at least one rare earth element.

41. The electroluminescent device of claim 31 wherein the dopant material comprises at least 20% by weight of the light emitting layer.

42. The electroluminescent device of claim 31 wherein the dopant material comprises at least 10% by weight of the light emitting layer.

43. The electroluminescent device of claim 31 wherein the dopant material comprises at least 5% by weight of the light emitting layer.

44. The electroluminescent device of claim 31 wherein the dopant material comprises at least 1% by weight of the light emitting layer.

45. The electroluminescent device of claim 31 wherein the dopant material is a first dopant material, wherein the light emitting layer includes a second dopant material, and wherein the first and second dopant materials are based upon different rare earth elements.

* * * * *